US005332025A

United States Patent [19]

Larsen

[11] Patent Number: 5,332,025

[45] Date of Patent: Jul. 26, 1994

[54] METHOD OF AND APPARATUS FOR PRODUCING A SERIES OF CASTING MOLDS OR MOLD PARTS

[75] Inventor: Jens P. Larsen, Albertslund, Denmark

[73] Assignee: Dansk Industri Syndikat A/S, Herlev, Denmark

[21] Appl. No.: 934,458

[22] PCT Filed: Mar. 20, 1990

[86] PCT No.: PCT/DK90/00079

§ 371 Date: Sep. 14, 1992

§ 102(e) Date: Sep. 14, 1992

[87] PCT Pub. No.: WO91/14525

PCT Pub. Date: Oct. 3, 1991

[51] Int. Cl.[5] ..... B22C 11/10; B22C 15/28

[52] U.S. Cl. ..... 164/456; 164/18; 164/38; 164/40; 164/187; 164/195; 164/154.1; 164/155.1

[58] Field of Search ..... 164/456, 18, 38, 40, 164/154, 155, 187, 195

[56] References Cited

U.S. PATENT DOCUMENTS

| | | | |
|---|---|---|---|
| 3,744,550 | 7/1973 | Larkin . | |
| 4,248,290 | 2/1981 | Hermes . | |
| 4,437,507 | 3/1984 | Seeley | 164/187 X |
| 4,791,974 | 12/1988 | Larsen . | |
| 4,853,868 | 8/1989 | Medwin . | |
| 4,997,025 | 3/1991 | Post et al. | 164/40 X |

FOREIGN PATENT DOCUMENTS

| | | | |
|---|---|---|---|
| 0164731 | 12/1985 | European Pat. Off. . | |
| 59-107746 | 6/1984 | Japan | 164/195 |

*Primary Examiner*—J. Reed Batten, Jr.
*Attorney, Agent, or Firm*—Larsen and Taylor

[57] ABSTRACT

In producing casting molds or mold parts by compacting mold sand in a molding chamber between two pattern plates, the volume of the molding chamber is measured and/or computed, such as by using sensors and a timer/controller capable of computing, before and after the compacting step. The values obtained are used to calculate a compaction ratio which is compared with a desired compaction ratio as a basis for making adjustments to the starting conditions, before the next mold or mold part is produced. In this manner it is possible to achieve a continuous correction of the compacting ratio to form correctly sized molds or mold parts in a series.

6 Claims, 4 Drawing Sheets

METHOD OF AND APPARATUS FOR PRODUCING A SERIES OF CASTING MOLDS OR MOLD PARTS

TECHNICAL FIELD

The present invention relates to a method for producing a series of casting molds or mold parts.

BACKGROUND ART

A method of this general kind is known from U.S. Pat. No. 4,248,290 (Hermes). According to this method, a closed-loop control arrangement is used to avoid impact damage when newly-produced molds are joined to a string of previously produced molds, and/or to control the dimensions of the molds in the-direction of conveying said string.

When producing casting molds or mold parts according to this known method, problems may arise due to variations in the hardness of the produced molds or mold parts, depending on the degree of compaction, with which the compacting operation is carried out. In many cases, these variations are not detected at a sufficiently early stage to make it possible to prevent them from causing severe problems.

Thus, the molds or mold parts may be too hard and dense, thus partly making it difficult to separate the molds from the castings, partly making it difficult for, gases produced during the casting operation to escape, thus causing gas porosities in the castings.

On the other hand, the molds or mold parts may be too brittle or soft, in which case they will be unable to withstand the impact of the molten casting metal being poured into the pouring cup.

SUMMARY OF THE INVENTION

It is the object of the present invention to provide a method of the kind initially referred to, with which the above-mentioned disadvantages can be reduced or eliminated, and this object is achieved in accordance with the present invention by filling a molding cavity with un-compacted particle material, pressing side walls of the cavity together to compact the material, measuring the volume of the mold before and after the step of pressing, comparing the measurements of the mold to desired measurements and automatically adjusting pressure or quantity of particle material before forming a new mold or mold part. In this manner, the variations are detected at an earlier moment in time, considerably closer to the moment in time, in which they actually arise, than with the previously known methods of this kind.

The present invention also relates to an apparatus for carrying out the method of the invention.

According to the invention, the apparatus comprises a molding cavity for compacting a casting mold bounded by at least two walls, one of which may be pressed toward the other and one of which carries a pattern corresponding to that of the desired mold part. The apparatus further includes filling, pressing sensing and control means which allow for automatic adjustment of molding conditions.

Advantageous embodiments of the method and the apparatus according to the present invention are explained in the following detailed portion of the present specification.

BRIEF DESCRIPTION OF THE DRAWING

In the following, the present invention will be explained in more detail with reference to the drawing, in which FIGS. 1 and 2 diagrammatically show an apparatus for carrying out the method according to the invention, FIGS. 3A, 3B and 3C diagrammatically show the production of molds and the placing of same in a mold string, later passing through a pouring station for molten metal.

DESCRIPTION OF THE PREFERRED EMBODIMENT

Figure 1:
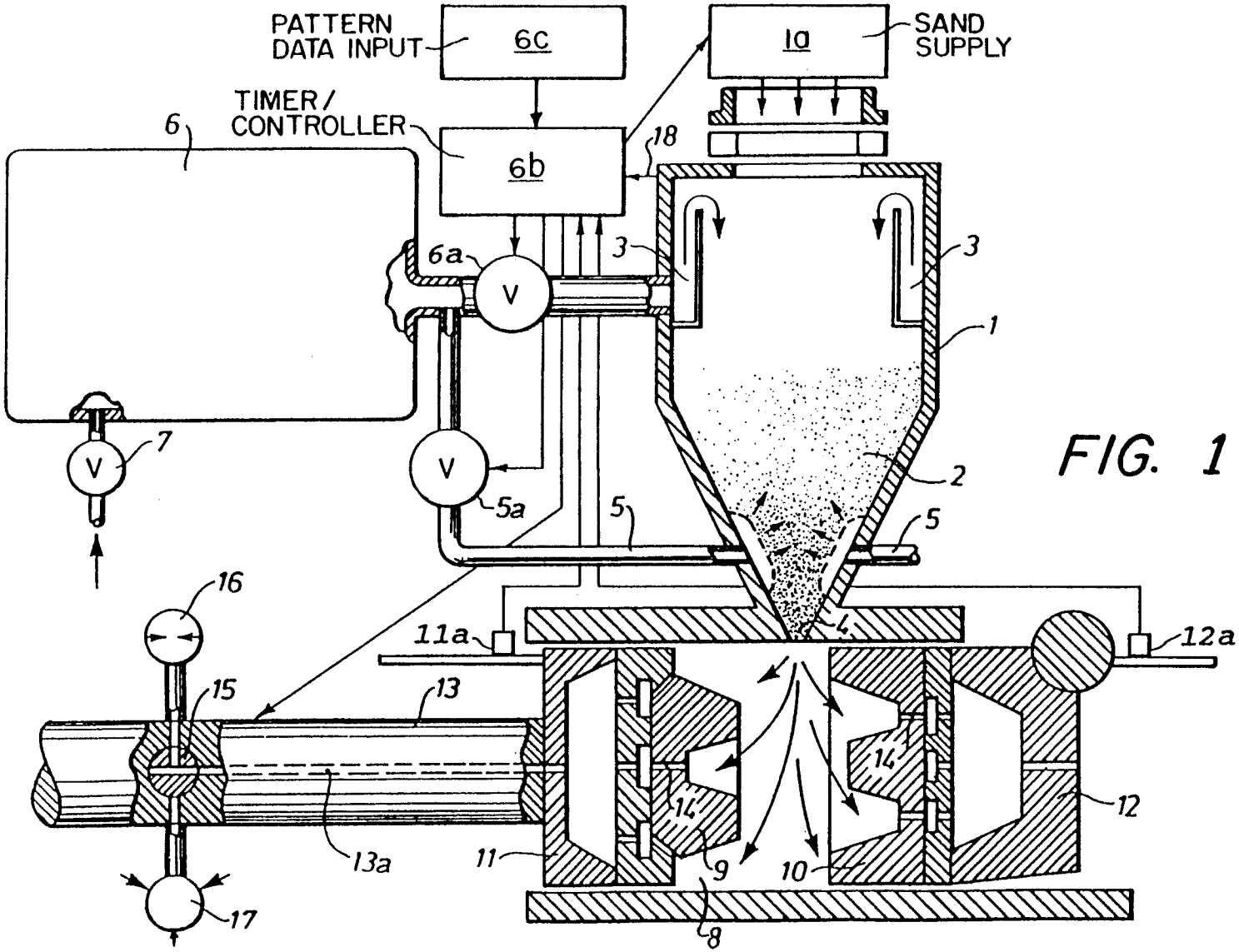

In the apparatus shown in FIG. 1, a supply chamber 1, adapted to receive sand from a sand supply container 1*a*, is used for temporarily storing mold sand 2. During the actual molding operation, air under pressure is supplied to the space above the sand 2 through air channels 3, which are connected to a compressed-air tank 6 through a valve 6*a* adapted to be controlled by a timer/-controller 6*b* in a manner partly explained in U.S. Pat. No. 4,791,974 (Larsen), partly—with special reference to the present invention—to be explained in more detail below. An outlet 4 connects the lower part of the supply chamber 1 to a mold chamber 8. immediately above the outlet 4, the lower part of the supply chamber 1 is provided with fluidization ducts 5, connected to the compressed-air tank 6 through a valve 5*a*, also adapted to be controlled by the timer/controller 6*b*.

When in operation, the top of the supply chamber 1 is connected to the sand supply container 1*a* in such a manner (not shown), that the air under pressure in the supply chamber 1 cannot escape in this direction.

The compressed-air tank 6 is provided with compressed air from a suitable source (not shown), connected to the tank through a valve 7.

The mold chamber 8, situated as shown below the supply chamber 1, is limited in the lateral direction by pattern plates 9 and 10. The pattern plates are supported by squeeze plates 11 and 12 respectively. A piston arrangement 13, of which only one piston is shown, is adapted to move the two squeeze plates 11 and 12 and hence the two pattern plates 9 and 10 towards each other under high pressure.

The squeeze plates 11 and 12 are provided with position sensors 11*a* and 12*a* respectively, signalling the position of each squeeze plate to the timer/controller 6*b*. On the basis of this positional information and information about the geometry of the pattern plates 9 and 10, the latter information having previously been entered into a pattern plate data input unit 6*c*, the timer/-controller 6*b* is able to compute various geometrical parameters for the mold chamber 8—both in the positions of the pattern plates shown in FIG. 1 and those shown in FIG. 2— such as the volume of the mold chamber and/or its linear dimension in a direction corresponding to the longitudinal direction of a mold string, of which the finished mold is to form a part. An example of such a mold string is diagrammatically shown in FIG. 3, showing a number of individual molds 19 arranged closely together to form a mold string 20, the spaces between the molds comprising casting cavities 21.

The pattern plates 9 and 10 comprise passages 14, which may be connected to either a vacuum source 16 or a pressure source 17 through a duct 13*a* and a three-way valve 15 accommodated in the piston arrangement 13, the valve 15 being controlled by the timer/controller 6*b*. In the position shown in FIG. 1, the injection of sand 2 from the supply chamber 1 into the mold chamber 8 has just begun, the pressure in the air channels 3 initially being kept comparatively low. Filling of cavities and parts with an intricate pattern on the molding surfaces of the pattern plates 9 and 10 is assisted by applying vacuum through the passages 14, the three-way valve 15 then being in the position shown in FIG. 1. This application of vacuum is preferably initiated already before applying pressure to the top of the supply chamber 1, such as approximately 1.0 second earlier. Transfer of sand 2 from the supply chamber 1 to the mold chamber 8 may be facilitated by supplying air under a suitable pressure through the fluidization ducts 5, thus causing the sand 2 in the lower part of the supply chamber 1 to be fluidized and hence to flow more easily into the mold chamber 8. The supply of fluidization air is preferably interrupted a short interval before the filling of the mold chamber 8 is completed, so as to avoid "dilution" of the last portion of sand entering the mold chamber 8.

The filling operation is terminated by closing the valve 6*a*, after which the pressure in the supply chamber 1 falls by exhaust through an exhaust valve (not shown) controlled by the timer/controller 6*b*.

After the filling operation has been terminated, but before the compacting operation begins, the timer/controller 6*b* will compute and store the various geometrical parameters relating to the mold chamber 8 in its instantaneous state, i.e. the state shown in FIG. 1, in which there is a considerable distance between the two pattern plates 9 and 10.

Figure 2:
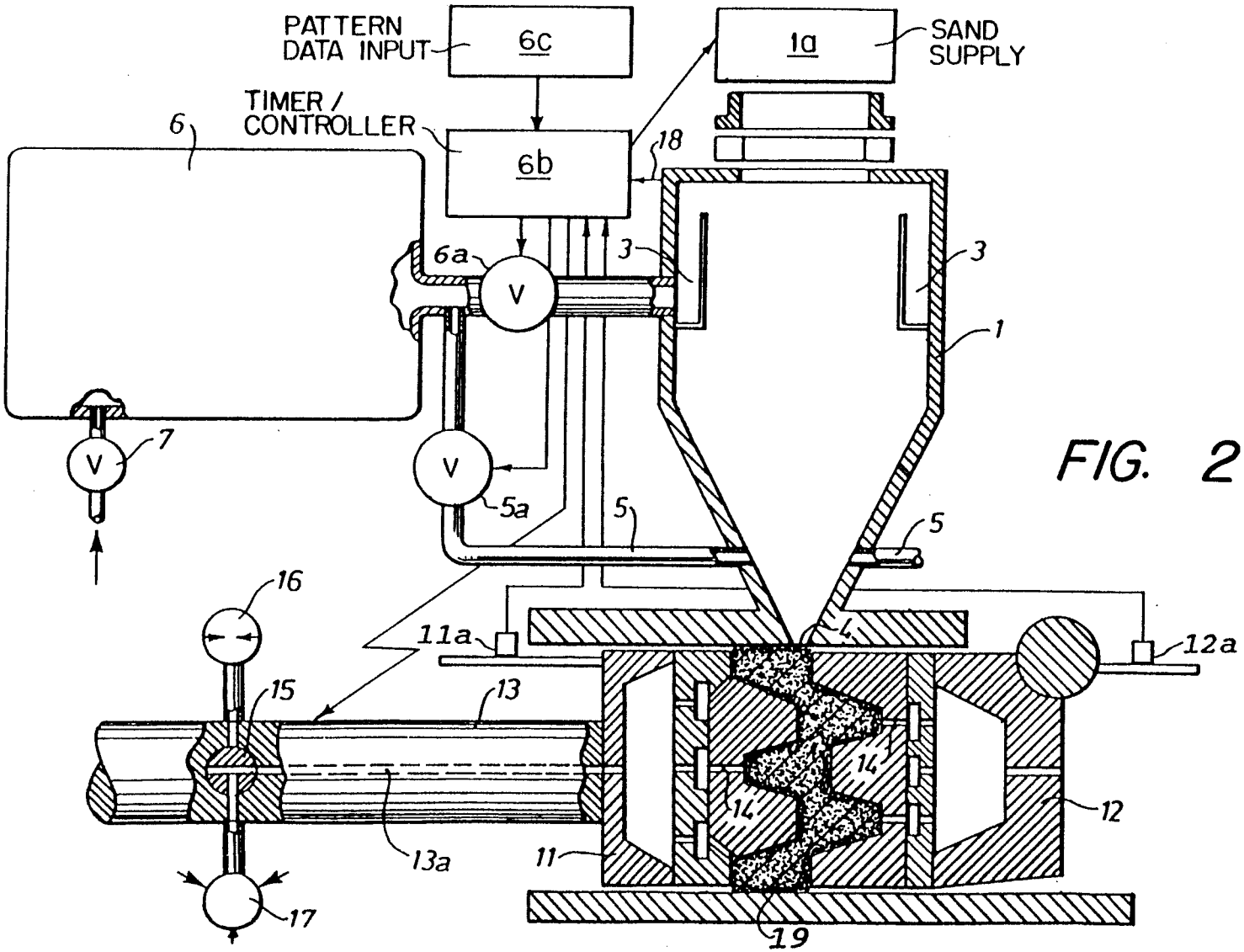

At a suitable point in time, which may be before, at or after the closing of valve 6*a*, the squeeze plates 11 and 12 are moved towards each other by the piston arrangement 13, operated by a suitable hydraulic cylinder (not shown), so that the sand in the mold chamber 8 is compressed further to the desired degree of compactness, vide FIG. 2.

When the above compacting operation has been completed, and while the squeeze plates 11 and 12 still ocupy these positions, the timer/controller 6*b* repeats the computing procedure described above, but this time computing and storing parameters relating to the new state of the mold chamber 8, in which both the volume and the above-mentioned linear dimension have been reduced to a certain extent, corresponding to the degree of compaction of the sand in the mold chamber 8.

The set of parameters selected and/or computed before and after the compacting operation are the volumes "$V_1$" and "$V_2$" respectively.

Figure 4:
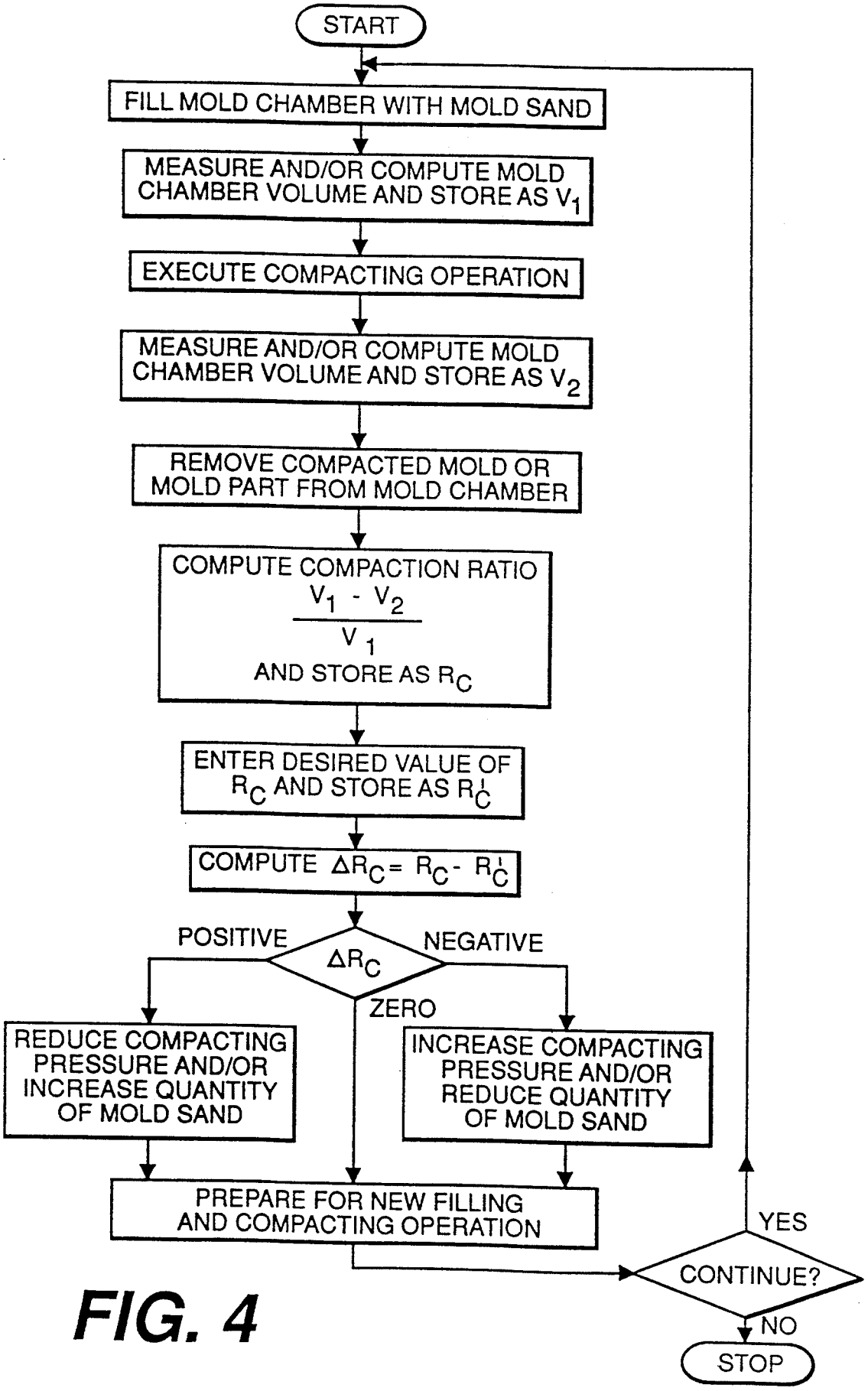
FIG. 4 shows an action sequence diagram corresponding to an exemplary embodiment of the method according to the invention.

In its most general form, the method according to the present invention may be carried out as shown in the action sequence diagram shown in FIG. 4. In brief, this method may be described as follows:

1. Make ready for compacting.
2. Find volume of mold chamber in its pre-compacting state (FIG. 1).
3. Execute compacting.
4. Find volume of mold chamber in its post-compacting state (FIG. 2).
5. From the results of 2 and 4, find the compaction ratio, and compare with the "ideal" compaction ratio.
6. Based on the results of the comparison in 5, adjust starting conditions (in 1 above) with a view to getting closer to the "ideal".
7. Repeat 1–6 for the next mold to be made.

As the sequence diagram of FIG. 4 is self-explanatory, further description of the method in this general form is deemed unnecessary.

The duct 13*a* and the passages 14 may subsequently be used for supplying air under pressure from the pressure source 17 in order to liberate the pattern plates 9 and 10 from the mold or mold part 19, which may suitably be used in an automatic foundry plant.

Figure 3B:
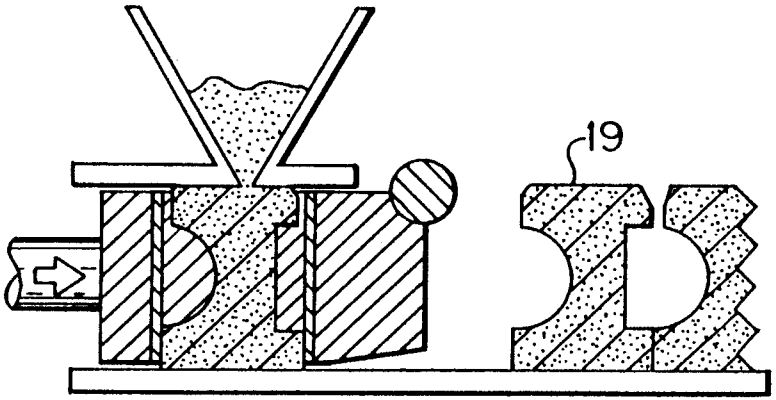
Figure 3A:
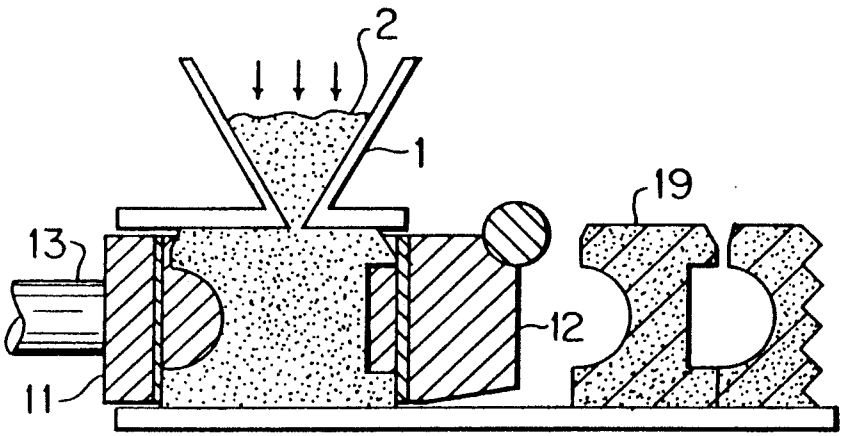
Figure 3C:
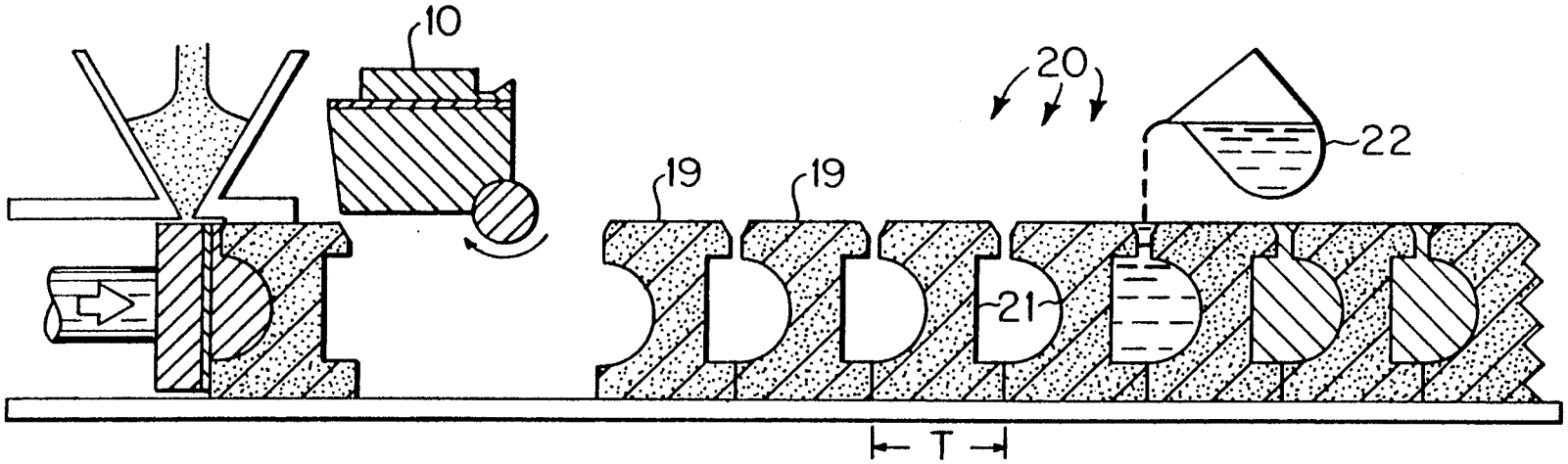

The timer/controller 6*b* may be constructed in any manner suitable to give the desired control of the pressure in the supply chamber 1, the supply of fluidization air through the ducts 5 and the application of vacuum through the duct 13*a* and the passages 14, as well as performing the computing operations necessary for carrying out the method of the present invention, and any other operations required, such as controlling the formation of the mold string as shown in FIGS. 3A, 3B and 3C and the various operations mentioned in the action sequence diagram of FIG. 4.

As shown in FIGS. 1 and 2, the timer/controller 6*b* is adapted to sense the pressure in the top of the supply chamber 1 by means of a sensing conduit 18, which may be a tube transmitting the pressure from the supply chamber 1 to a suitable pressure sensor in the unit 6*b*, or an electric cable connecting a pressure sensor (not shown) in the supply chamber 1 to-suitable components in the unit 6*b*. The timer/controller 6*b* is, however, preferably a unit containing one or a number of microprocessors with suitable interface, input, output and monitoring equipment, so as to make it easier to achieve whichever pressure and vacuum functions of time and other control functions that are desired in each case, using open or closed loop control as required to obtain optimal results with each type of pattern plate.

As mentioned initially, the compaction ratio is of importance in producing molds of a suitable compactness; thus, a too loosely compacted mold will easily be damaged during handling before casting or during the casting operation itself and thus be the cause of defective castings or—worse—molten metal taking wrong paths and damaging the equipment, whereas an excessively compacted mold will have a low gas permeability with the consequent risk of so-called pouring gases being trapped in the castings, thus making these porous and hence weak.

The linear dimension of the mold as measured in the conveying direction has no direct bearing on the quality of the mold as such, but is of great importance when using the mold produced in a casting plant of the kind illustrated in FIGS. 3A, 3B and 3C. FIGS. 3A, 3B and 3C show inter alia an automatic casting station symbolized by a ladle 22. If the effective "length" or "thickness" T of each mold 19 were to vary, then obviously the position of the pouring cup in question below the ladle 22 would also vary. This problem has previously been solved by mounting the ladle or its equivalent on a carriage, that may be moved in the longitudinal direction of the mold string 20 to ensure that the metal is always poured straight into a pouring cup. The movement of a hearty automatic pouring unit is of course complicated and time consuming, and hence a costly solution. This problem may be solved by utilizing the principles of the present invention for controlling the said linear dimension, thus ensuring that the lengthwise dimension of the mold does not vary or only varies slightly within the degree of tolerance acceptable for the pouring operation, thus also avoiding large movements and making it possible to achieve a considerably increased output from a casting plant. Moreover, the level of the metal in the pouring unit is no longer subjected to sudden movements, as the pouring unit symbolized by the ladle 22 is only moved in small increments or not at all, resulting in a stable pouring operation and consequently fewer rejected castings.

It is possible to combine the specific method outlined in FIG. 4 with such control of the linear dimension, so that the molds produced have the correct degree of compactness as well as the correct linear dimension for use in the mold string. This combination is not illustrated in the drawings, but persons skilled in the art of automation will be able to devise such combinations without further guidance, for which reason further description is deemed to be unnecessary.

The exemplary embodiments shown on the drawings are, of course, only intended to illustrate the principles of the present invention without limiting the scope of same. Thus the principles of the present invention may also be applied to methods and apparatus for controlling the degree of compaction in horizontally parted molds, either with or without flasks.

I claim:

1. A method of producing a series of casting molds or casting mold parts comprising a compacted particle material, said method comprising the steps of:

a) adding uncompacted particle material to a molding cavity adapted for forming a casting mold or mold part and bounded by at least two walls, at least one of said walls being movable towards the other of said walls, and at least one of said walls carrying a pattern, a shape of said pattern corresponding to a shape of a corresponding part of a casting to be cast using said mold or mold part;

b) measuring or computing a volume of the molding cavity and storing said volume;

c) pressing said walls toward each other so that the particle material therein is compacted;

d) measuring or computing a volume of the compacted molding cavity and storing said volume of the compacted molding cavity;

e) moving said walls apart;

f) removing the compacted starting mold or mold part from the molding cavity;

g) computing a compaction ratio of the mold or mold part by subtracting the volume of the compacted molding cavity from the volume of the molding cavity before said step of pressing and then dividing the result by the volume of the molding cavity before said step of pressing;

h) comparing the compaction ratio to a desired value to determine whether the compaction ratio is greater or less than a desired compaction ratio and reducing or increasing, respectively, compacting pressure used during said step of pressing and/or quantity of uncompacted particle material introduced during said step of adding; and i) repeating the above-recited steps to form a desired number of casting molds or casting mold parts in the series.

2. The method according to claim 1, further comprising, after said step of compacting, the step of calculating a basis for determining a magnitude of change in the compacting pressure and/or the quantity of particle material introduced that is effected after producing each casting mold or mold part but before producing a subsequent casting mold or mold part by adding a difference between the compaction ratio and the desired compaction ratio to a sum of differences between the compaction ratio and the desired compaction ratio of previously formed casting molds or casting mold parts in the series of casting molds or mold parts.

3. The method according to claim 2 wherein said magnitude of change in the compacting pressure and/or quantity of particle material introduced is calculated as a proportion of said sum of the differences.

4. The method according to claim 1 wherein said step of adding uncompacted particle material comprises projecting the particle material into the molding cavity at a high velocity and said reduction or increase in quantity of introduced particle material is effected by changing pressure or vacuum used to project particle material into the molding cavity and/or changing duration of the step of adding.

5. An apparatus for automatically producing a series of casting molds or casting mold parts comprising:

a) a molding cavity adapted for forming a casting mold or a mold part, said cavity being bounded by at least two walls, at least one of said walls being movable towards the other wall, and at least one of said walls carrying a pattern, the shape of said pattern corresponding to a shape of a corresponding part of a casting to be cast using said mold or mold part;

b) filling means adapted to introduce particle material into said molding cavity;

c) pressing means adapted to press said walls toward each other to compact particle material introduced into the molding cavity;

d) measuring means for measuring or computing volume of said molding cavity before and after said step of pressing;

e) control means for calculating a compaction ratio of the casting mold or mold part by subtracting the volume of the compacted molding cavity from the volume of the molding cavity before said step of pressing and then dividing the result by the volume of the molding cavity before said step of pressing, said control means further providing means for computing a difference between said compaction ratio and a desired value of compaction ratio and for adjusting compacting pressure and/or quantity of introduced particle material to reduce said difference.

6. The apparatus according to claim 5 further comprising sand supply means for projecting particle material into said molding cavity at a high velocity, said control means providing means for controlling are least one of pressure, fluidization pressure, and vacuum used to project the particle material into the molding cavity and duration of a mold-filling process.

* * * * *